US009260978B2

(12) United States Patent
Holmes et al.

(10) Patent No.: US 9,260,978 B2
(45) Date of Patent: Feb. 16, 2016

(54) SYSTEM AND METHOD FOR HEATING A STATOR SEGMENT

(75) Inventors: James Bradford Holmes, Fountain Inn, SC (US); Charles Van Buchan, Greer, SC (US); Jason Matthew Clark, Loveland, OH (US)

(73) Assignee: General Electric Company, Schenectady, NY (US)

( * ) Notice: Subject to any disclaimer, the term of this patent is extended or adjusted under 35 U.S.C. 154(b) by 934 days.

(21) Appl. No.: 13/423,349

(22) Filed: Mar. 19, 2012

(65) Prior Publication Data

US 2013/0240504 A1 Sep. 19, 2013

(51) Int. Cl.

| | |
|---|---|
| ***H05B 6/02*** | (2006.01) |
| ***H05B 6/22*** | (2006.01) |
| ***F03B 1/04*** | (2006.01) |
| ***F01D 25/10*** | (2006.01) |
| ***F01D 5/00*** | (2006.01) |

(52) U.S. Cl.

CPC ..... *F01D 25/10* (2013.01); *F01D 5/005* (2013.01); *F05D 2230/70* (2013.01)

(58) Field of Classification Search

CPC ..... F01D 25/10; F01D 5/005; F05D 2230/70
USPC ..... 219/618, 385, 635, 653, 674; 373/144–152, 153, 156; 248/317, 340, 248/610, 612, 613, 589, 58, 62; 29/426.1, 29/899.1, 899.21, 899.722, 899.23, 29/402.04, 402.18, 899.7, 899.71
See application file for complete search history.

(56) References Cited

U.S. PATENT DOCUMENTS

| | | | | | |
|---|---|---|---|---|---|
| 894,305 | A | * | 7/1908 | Wouters | 310/262 |
| 2,449,325 | A | | 6/1945 | Rudd et al. | |
| 4,119,825 | A | | 10/1978 | Taylor et al. | |
| 4,611,744 | A | | 9/1986 | Fraser et al. | |
| 4,749,833 | A | * | 6/1988 | Novorsky et al. | 219/603 |
| 5,033,938 | A | | 7/1991 | Fraser et al. | |
| 5,062,205 | A | | 11/1991 | Fraser | |
| 5,109,606 | A | | 5/1992 | DeMichael et al. | |
| 5,606,796 | A | | 3/1997 | Fraser | |
| 5,887,019 | A | * | 3/1999 | Swanger | 373/153 |
| 5,971,338 | A | * | 10/1999 | Olsen et al. | 248/317 |
| 6,115,917 | A | | 9/2000 | Nolan et al. | |
| 6,578,265 | B2 | | 6/2003 | Boschet et al. | |
| 7,934,302 | B2 | | 5/2011 | Kalmar et al. | |
| 2009/0313822 | A1 | | 12/2009 | Lee et al. | |
| 2010/0071183 | A1 | | 3/2010 | McCarvill | |
| 2010/0151145 | A1 | | 6/2010 | Richter et al. | |
| 2010/0263183 | A1 | | 10/2010 | Holmes et al. | |

* cited by examiner

*Primary Examiner* — Quang Van
(74) *Attorney, Agent, or Firm* — Dority & Manning, P.A.

(57) ABSTRACT

A system for heating a stator segment includes a first frame member, a plurality of arms extending radially from the first frame member, and a heater releasably connected to each arm. The system further includes a biasing element for biasing each heater away from the first frame member.

20 Claims, 8 Drawing Sheets

SYSTEM AND METHOD FOR HEATING A STATOR SEGMENT

FIELD OF THE INVENTION

The present invention generally involves a system and method for heating a stator segment. In particular, embodiments of the present invention may facilitate heating and removal of the stator segment from a compressor without requiring removal of the rotor.

BACKGROUND OF THE INVENTION

Compressors are widely used in industrial and commercial operations. For example, a typical commercial gas turbine used to generate electrical power includes a compressor at the front, one or more combustors around the middle, and a turbine at the rear. A casing generally surrounds the compressor to contain a working fluid flowing through the compressor, and alternating stages of rotating blades and stationary vanes inside the casing progressively impart kinetic energy to the working fluid to produce a compressed working fluid at a highly energized state. Each rotating blade may be releasably connected to a rotor located along an axial centerline of the compressor, and each stator vane may be attached to a stator segment. For example, six stator segments may circumferentially surround the rotor, with three stator segments in each half of the casing. The casing may include a hook fit slot that extends circumferentially around the casing for each stage of stator vanes, and the stator segments may releasably slide into the hook fit slots.

Periodically, the stator vanes and stator segments in the compressor must be removed and/or replaced. Doing so typically requires at least partial removal of the casing surrounding the compressor to provide access to the stator vanes and stator segments. With the rotor still in place, however, access is somewhat restricted, and particular care must be taken to ensure that removal of the stator vanes and stator segments does not result in collateral damage to the rotor, casing, or adjacent rows of rotating blades. For example, a cutting tool may be manually inserted around the rotor to individually cut each stator vane, and once all stator vanes have been cut from a particular stator segment, the stator segment may be removed from the hook fit slots in the casing.

Occasionally, however, corrosion, creep, and/or other plastic deformation of the hook fit slots and/or stator segments prevent the stator segments from readily sliding out of the casing. For example, the stator segments may be constructed from carbon steel, and moisture from condensation, water washes, and other environmental factors may product corrosion that makes it extremely difficult to remove the stator segments from the hook fit slots. Rapid heating and cold water quenching of the stator segments is a very effective method to loosen the corrosion and remove the stator segments. However, the current method to heat the stator segments uses a torch or other open flame that may inadvertently damage the adjacent components and presents a fire hazard if exposed to rotor dams temporarily installed to protect the rotating blades. In addition, a single torch has a limited surface area for heating the stator segments, requiring several hours to heat a single stator segment. Therefore, an improved system and method for heating a stator segment would be useful.

BRIEF DESCRIPTION OF THE INVENTION

Aspects and advantages of the invention are set forth below in the following description, or may be obvious from the description, or may be learned through practice of the invention.

One embodiment of the present invention is a system for heating a stator segment. The system includes a first frame member, a plurality of arms extending radially from the first frame member, and a heater releasably connected to each arm. The system further includes means for biasing each heater away from the first frame member.

Another embodiment of the present invention is a system for heating a stator segment that includes a first frame member, a second frame member separated from the first frame member, and a plurality of heaters connected to the second frame member. The system further includes means for biasing each heater away from the first frame member.

The present invention may also include a system for heating a stator segment that includes a first frame member and a plurality of arms extending radially from the first frame member. A heater is releasably connected to each arm, and a biasing element is operably connected to the first frame member and each heater to bias each heater away from the first frame member.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
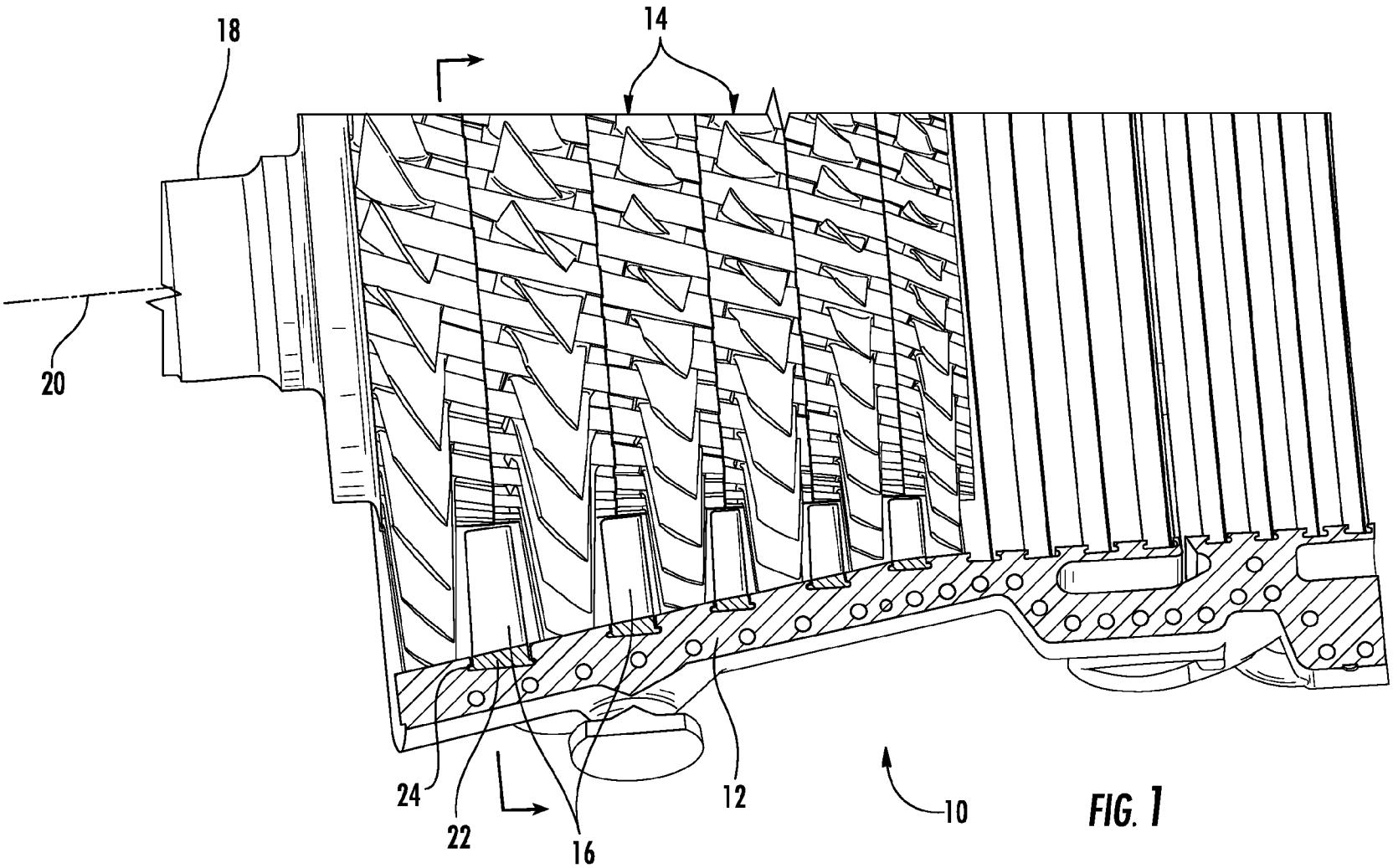
FIG. 1 is a side view of an exemplary compressor with a portion of the casing removed.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for heating a compressor stator segment. In particular embodiments, the system may include a collapsible frame that conforms to the various diameters of the various stages inside the compressor and allows the system to be quickly inserted between a rotor and a casing. A series of heaters attached to the collapsible frame rapidly heat each stator segment, and the collapsible frame allows the system to be quickly removed for a subsequent quenching sequence. The system and method are thus designed to quickly heat stator segments while also reducing any danger of collateral damages to adjacent components. As a result, the system and method aid in the removal of stator segments from the compressor without requiring removal of the adjacent components. Although exemplary embodiments of the present invention will be described generally in the context of a compressor stator segment for purposes of illustration, one of ordinary skill in the art will readily appreciate that embodiments of the present invention are not limited to heating compressor stator segments unless specifically recited in the claims.

Figure 2:
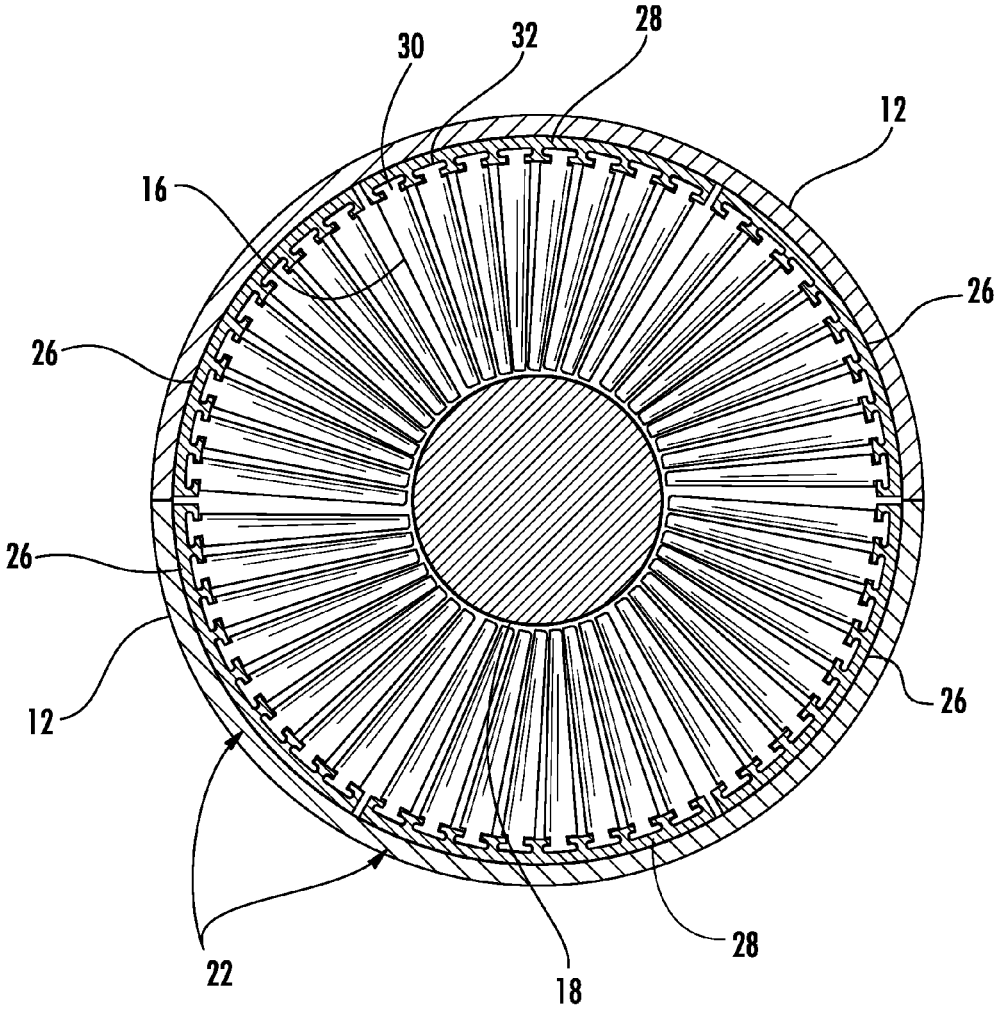
FIG. 2 is an axial cross-section of the exemplary compressor shown in FIG. 1 taken along line A-A.

FIG. 1 provides a side view of an exemplary compressor 10, and FIG. 2 provides an axial cross-section view of the exemplary compressor 10 shown in FIG. 1 taken along line A-A. A casing 12 that generally surrounds the compressor 10 has been partially removed from FIG. 1 to reveal that the compressor 10 includes alternating stages of rotating blades 14 and stator vanes 16 inside the casing 12. Each rotating blade 14 may be releasably connected to a rotor 18 located along an axial centerline 20 of the compressor 10, and each stator vane 16 may be fixedly or releasably attached to a stator segment 22. As shown most clearly in FIG. 1, the casing 12 may include a hook fit slot 24 for each stage of stator vanes 16, and the stator segments 22 may releasably slide into the hook fit slots 24. Referring to FIG. 2, the compressor 10 may include, for example, six stator segments 22 that circumferentially surround the rotor 18, with each half of the casing 12 holding two side stator segments 26 and one center stator segment 28. Each stator vane 16 may in turn include a dovetail extension 30 that axially slides into a complementary dovetail slot 32 in the stator segments 22 to securely hold the stator vanes 16 in place with respect to the rotor 18. In this manner, the rotor 18 may turn each stage of rotating blades 14 while the casing 12 and stator segments 22 hold each stage of stator vanes 16 in place.

Figure 3:
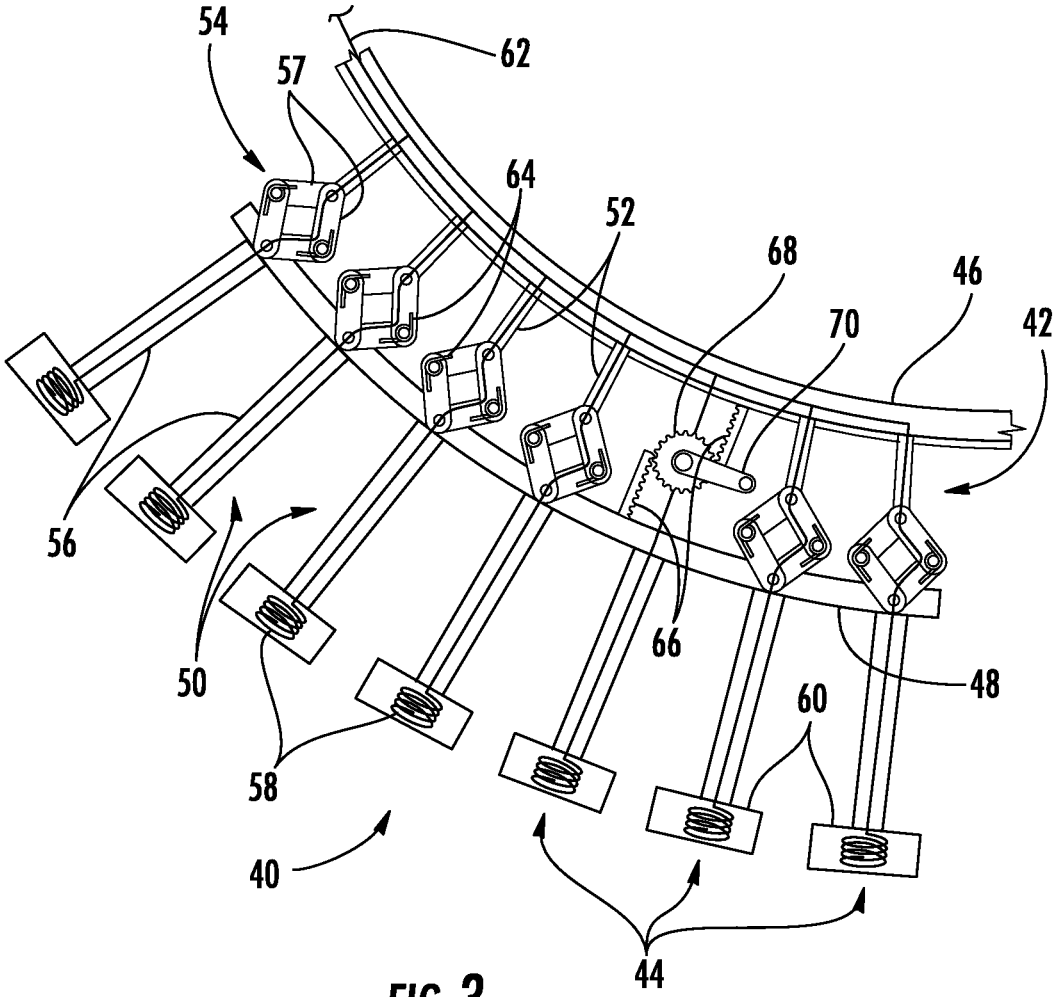
FIG. 3 is a perspective view of a system for heating a stator segment according to a first embodiment of the present invention.

FIG. 3 provides a perspective view of a system 40 for heating stator segments 22 according to a first embodiment of the present invention. As shown, the system 40 generally includes a collapsible frame 42, one or more heaters 44, and means for biasing each heater 44 toward and/or away from the stator segment 22.

The collapsible frame 42 enables the system 40 to be easily manipulated in the confined space between the casing 12 and the rotor 18. In the particular embodiment shown in FIG. 3, the collapsible frame 42 includes first and second frame members 46, 48 separated by a plurality of arms 50 that extend radially between the first and second frame members 46, 48. The first frame member 46 may have an arcuate shape that generally conforms to an outer surface of the rotor 18, and the second frame member 48 may have an arcuate shape that generally conforms to the casing 12 and/or stator segment 22. Inasmuch as the radius or shape of the outer surface of the rotor 18, casing 12, and/or stator segment 22 may change slightly, depending on the particular stage inside the compressor 10, the system 40 may utilize different first and second frame members 46, 48 for each stage of the compressor 10, with each first and second frame member 46, 48 sized and shaped to complement a particular stage of the compressor 10.

The arms 50 generally extend between the first and second frame members 46, 48 to allow relative or reciprocal movement between the first and second frame members 46, 48. For example, in the particular embodiment shown in FIG. 3, each arm 50 includes an upper arm segment 52 connected by an articulated portion 54 to a lower arm segment 56. The articulated portion 54 may include, for example, multiple braces 57 pivotally connected to one another and to the upper and lower arm segments 52, 56. In this manner, the articulated portion 54 of each arm 50 may alternately expand or retract to move the first frame member 46 radially with respect to the second frame member 48.

The heaters 44 are generally connected to the arms 50 and may include any suitable device known to one of ordinary skill in the art for transferring heat to another object. For example, as shown in FIG. 3, each heater may include a resistive or induction coil 58 immersed in or surrounded by a thermally conductive material such as a ceramic block 60. Wiring 62 incorporated into or routed through the collapsible frame 42 and/or arms 50 may supply the induction coils 58 with power to rapidly heat the ceramic blocks 60. The ceramic blocks 60 may in turn be placed against the stator segment 22 to transfer heat from the induction coils 58 to the stator segment 22.

The means for biasing each heater 44 toward and/or away from the stator segment 22 may include a biasing element operably connected to the first frame member 46 and each heater 44 to bias each heater 44 toward and/or away from the first frame member 46. In the particular embodiment shown in FIG. 3, the means for biasing each heater 44 toward and/or away from the stator segment 22 includes first means for biasing each heater 44 away from the first frame member 46 or toward the stator segment 22 and separate second means for biasing each heater 44 toward the first frame member 46 or away from the stator segment 22. The structure for the first and second means may include any mechanical, pneumatic, hydraulic, or electrical device known in the art for moving one component with respect to another. For example, the first and/or second means may include a threaded engagement, a flexible coupling, a piston, a solenoid, a magnetic coupling, or other suitable device connected to the first frame member 46, second frame member 48, and/or heaters 44 to bias each heater 44 toward and/or away from the stator segment 22. In the particular embodiment shown in FIG. 3, the first means for biasing each heater 44 away from the first frame member 46 may include a coiled spring 64 wrapped around one or more of the pivotal connections of the articulated portion 54. In this manner, the coiled springs 64 may bias the articulated portion 54 to the expanded position, thereby moving the heaters 44 away from the first frame member 46 and toward the stator segment 22. Conversely, the second means for biasing each heater 44 toward the first frame member 46 may include rack 66 and pinion 68 connections between the first and second frame members 46, 48. A handle or lever 70 pivotally connected to the pinion 68 may be used to rotate the pinion 68 counter-clockwise, causing the geared connection between the rack 66 and pinion 68 to move the heater 44 toward the first frame member 46 and away from the stator segment 22.

Figure 4:
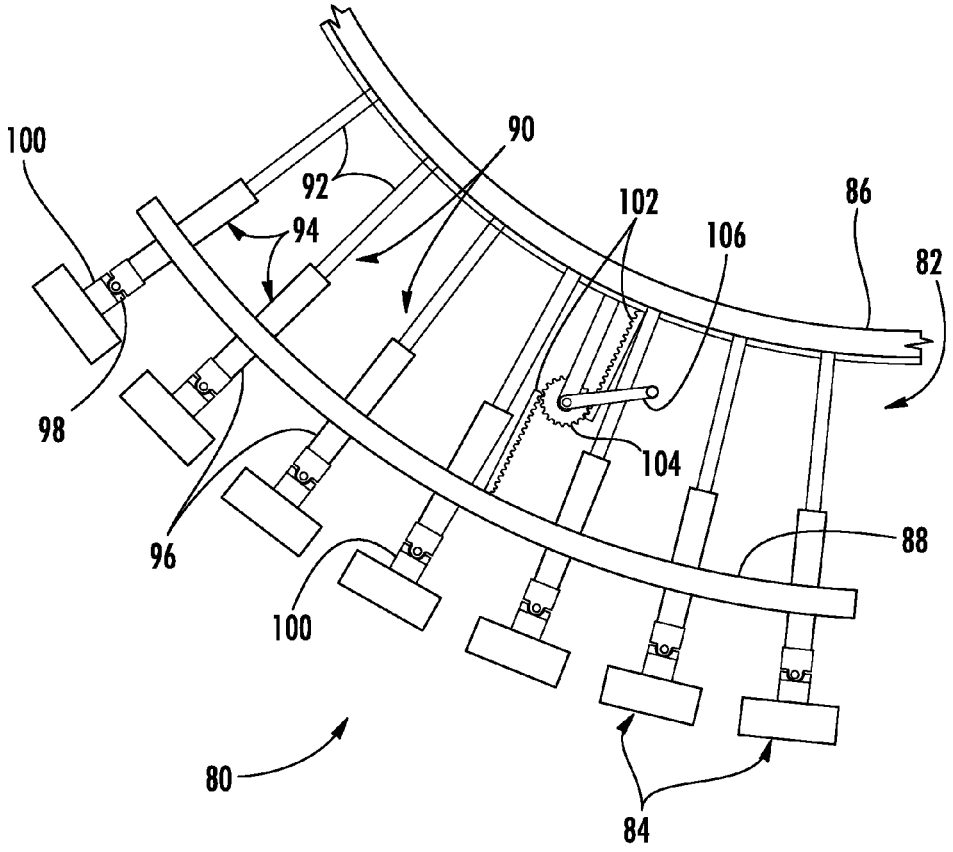
FIG. 4 is a perspective view of a system for heating a stator segment according to a second embodiment of the present invention.

FIG. 4 provides a perspective view of a system 80 for heating stator segments 22 according to a second embodiment of the present invention. As shown, the system 80 again includes a collapsible frame 82, one or more heaters 84, and means for biasing each heater 84 toward and/or away from the stator segment 22.

The collapsible frame 82 again enables the system 80 to be easily manipulated in the confined space between the casing 12 and the rotor 18. In the particular embodiment shown in FIG. 4, the collapsible frame 82 again includes first and second frame members 86, 88 separated by a plurality of arms 90 that extend radially between the first and second frame members 86, 88. The first and second frame members 86, 88 may again have arcuate shapes that generally conform to an outer surface of the rotor 18 and the casing 12 and/or stator segment 22, respectively, as previously described with respect to the embodiment shown in FIG. 3.

The arms 90 generally extend between the first and second frame members 86, 88 to again allow relative or reciprocal movement between the first and second frame members 86, 88. In the particular embodiment shown in FIG. 4, each arm 90 includes an upper arm segment 92 inserted into a lower arm segment 96 to form an articulating piston 94 between the first and second frame members 86, 88. In this manner, the articulating piston 94 of each arm 90 may alternately push or pull the upper arm segment 92 to move the first frame member 86 radially with respect to the second frame member 88.

The heaters 84 are again generally connected to the arms 90 and may include any suitable device known to one of ordinary skill in the art for transferring heat to another object, as previously discussed with respect to the embodiment shown in FIG. 3. In the particular embodiment shown in FIG. 4, the heaters 84 are pivotally and/or releasably connected to each arm 90. Specifically, a pivotal connection 98 between the arms 90 and the heaters 84 may allow the angle of the heaters 84 to adjust to the particular angle and curvature of the stator segments 22, thereby enhancing the surface-to-surface contact between the heaters 84 and the stator segments 22. The pivotal connection 98 may include, for example, a ball bearing, a universal joint, or other flexible coupling that allows angular movement between the arms 90 and the heaters 84. Alternately, or in addition, a releasable coupling 100 between the arms 90 and the heaters 84 enables quick removal and replacement of individual heaters 44 that wear out or otherwise become inoperable. The releasable coupling 100 may include, for example, a threaded connection, male and female fittings, a clamp, a quick release fitting, or other suitable mechanical device known in the art for releasably attaching one component to another.

In the particular embodiment shown in FIG. 4, the means for biasing each heater 84 toward and/or away from the stator segment 22 includes first means for biasing each heater 84 away from the first frame member 86 and separate second means for biasing each heater 84 toward the first frame member 86. The structure for the first and second means may again include any mechanical, pneumatic, hydraulic, or electrical device known in the art for moving one component with respect to another. For example, the first and/or second means may include a threaded engagement, a flexible coupling, a piston, a solenoid, a magnetic coupling, or other suitable device connected to the first frame member 86, second frame member 88, and/or heaters 84 to bias each heater 84 toward and/or away from the stator segment 22. In the particular embodiment shown in FIG. 4, the first means for biasing each heater 84 away from the first frame member 86 may include pneumatic and/or hydraulic pressure contained in the lower arm segment 96 to bias the upper arm segment 92 out of and away from the lower arm segment 96. In this manner, the pneumatic and/or hydraulic pressure in the lower arm segment 96 may bias or move the heaters 84 away from the first frame member 86 and toward the stator segment 22. Conversely, the second means for biasing each heater 84 toward the first frame member 86 may include rack 102 and pinion 104 connections between the first and second frame members 86, 88, with a handle or lever 106 to rotate the pinion 104 counter-clockwise to move the heater 84 toward the first frame member 86 and away from the stator segment 22.

Based on the disclosure and teachings herein, one of ordinary skill in the art can readily appreciate multiple other structures and arrangements for allowing relative or reciprocal movement between the heaters 44, 84 and the first frame member 46, 86 or for biasing the heaters 44, 84 toward or away from the first frame member 46, 86 and/or stator segment 22. For example, in alternate embodiments, the articulated portion 54 shown in FIG. 3 may be replaced with any suitable structure that allows relative or reciprocal movement between the heaters 44 and the first frame member 46. Similarly, the pinions 68, 104 shown in FIGS. 3 and 4 may be spring-biased in the clockwise direction, obviating the need for the coiled spring 64 shown in FIG. 3 or the pressurized fluid in the lower arm segment 96 described with respect to FIG. 4. These and other variations are suitable equivalent structures within the scope of various embodiments of the present invention based on the disclosures and teachings herein.

Figure 5:
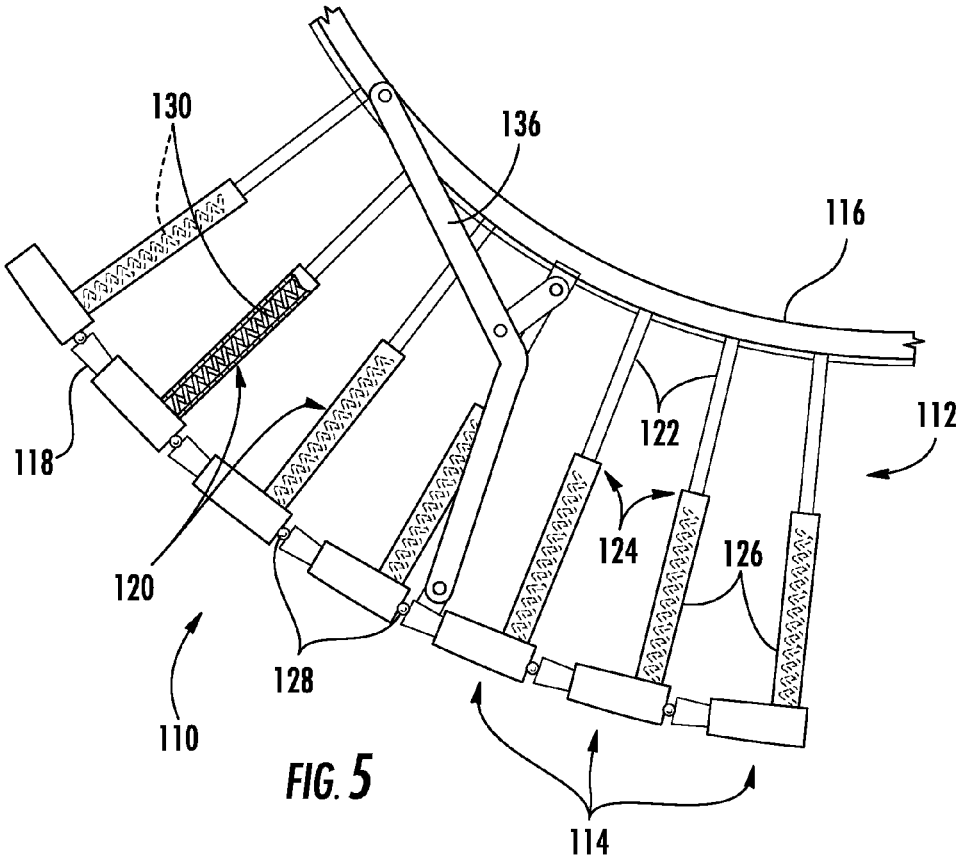
FIG. 5 is a perspective view of a system for heating a stator segment according to a third embodiment of the present invention.

FIG. 5 provides a perspective view of a system 110 for heating stator segments 22 according to a third embodiment of the present invention. As shown, the system 110 again includes a collapsible frame 112, one or more heaters 114, and means for biasing each heater 114 toward and/or away from the stator segment 22.

The collapsible frame 112 again enables the system 110 to be easily manipulated in the confined space between the casing 12 and the rotor 18. In the particular embodiment shown in FIG. 5, the collapsible frame 112 again includes first and second frame members 116, 118 separated by a plurality of arms 120 that extend radially between the first and second frame members 116, 118. The first frame member 116 again has an arcuate shape that generally conforms to an outer surface of the rotor 18, as previously described with respect to the embodiment shown in FIGS. 3 and 4. In addition, the second frame member 118 may pivotally connect to adjacent heaters 114 so that the combined shape or contour of the second frame member 118 and the heaters 114 generally conforms to the casing 12 and/or stator segment 22.

The arms 120 generally extend between the first and second frame members 116, 118 to again allow relative or reciprocal movement between the first and second frame members 116, 118. In the particular embodiment shown in FIG. 5, each arm 120 includes an upper arm segment 122 inserted into a lower arm segment 126 to again form an articulating piston 124 between the first and second frame members 116, 118. In this manner, the articulating piston 124 of each arm 120 may alternately push or pull the upper arm segment 122 to move the first frame member 116 radially with respect to the second frame member 118.

The heaters 114 may again include any suitable device known to one of ordinary skill in the art for transferring heat to another object, as previously discussed. In the particular embodiment shown in FIG. 5, each heater 114 is pivotally connected to the second frame member 118. Specifically, a pivotal connection 128 between the second frame member 118 and each heater 114 allows the angle of the heaters 114 to adjust to the particular angle and curvature of the stator segments 22, thereby enhancing the surface-to-surface contact between the heaters 114 and the stator segments 22. The pivotal connection 128 may include, for example, a ball bearing, a universal joint, or other flexible coupling that allows angular movement between the second frame member 118 and the heaters 114.

In the particular embodiment shown in FIG. 5, the means for biasing each heater 114 toward and/or away from the stator segment 22 includes first means for biasing each heater 114 away from the first frame member 116 and separate second means for biasing each heater 114 toward the first frame member 116. The structure for the first and second means may again include any mechanical, pneumatic, hydraulic, or electrical device known in the art for moving one component with respect to another. For example, the first and/or second means may include a threaded engagement, a flexible coupling, a piston, a solenoid, a magnetic coupling, or other suitable device connected to the first frame member 116, second frame member 118, and/or heaters 114 to bias each heater 114 toward and/or away from the stator segment 22. In the particular embodiment shown in FIG. 5, the first means for biasing each heater 114 away from the first frame member 116 may include a spring 130 connected between the first and second members 116, 118 to bias the upper arm segment 122 out of and away from the lower arm segment 126. In this manner, the spring 130 may bias or move the heaters 114 away from the first frame member 116 and toward the stator segment 22. Conversely, the second means for biasing each heater 114 toward the first frame member 116 may include a handle or lever 136 pivotally connected to the first and second frame members 116, 118. Lifting the lever 136 shown in FIG. 5 will overcome the force of the spring 130 to move the second frame member 118, and thus the heaters 114, toward the first frame member 114 and away from the stator segment 22.

Figure 6:
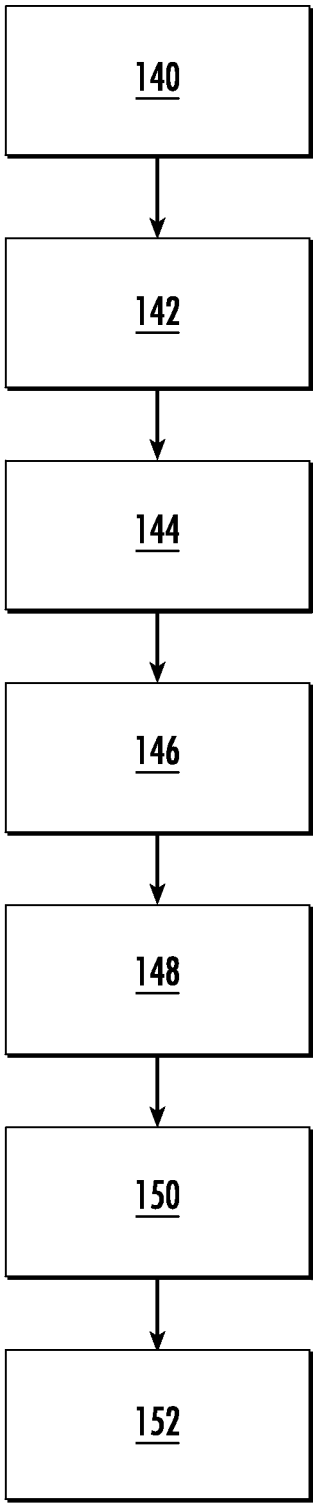
FIG. 6 is a flow diagram of a method for heating a stator segment according to one embodiment of the present invention.
Figure 7:
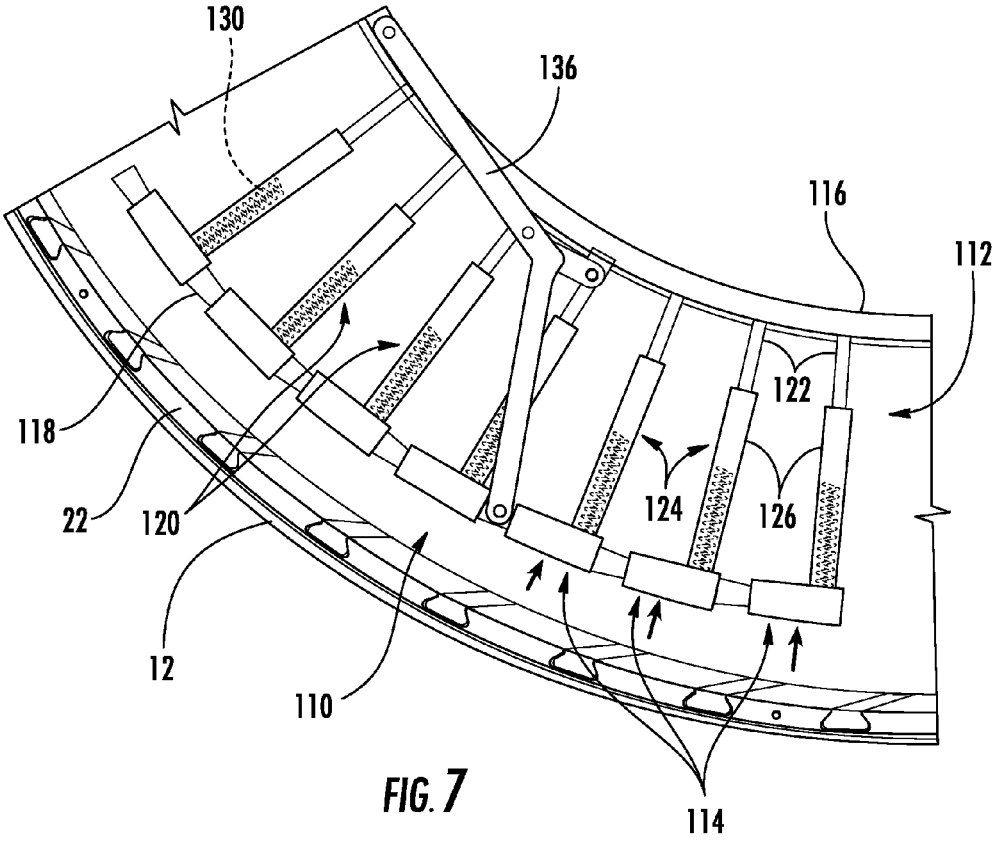
FIG. 7 is a perspective view of the system shown in FIG. 5 being inserted between a rotor and a casing.
Figure 8:
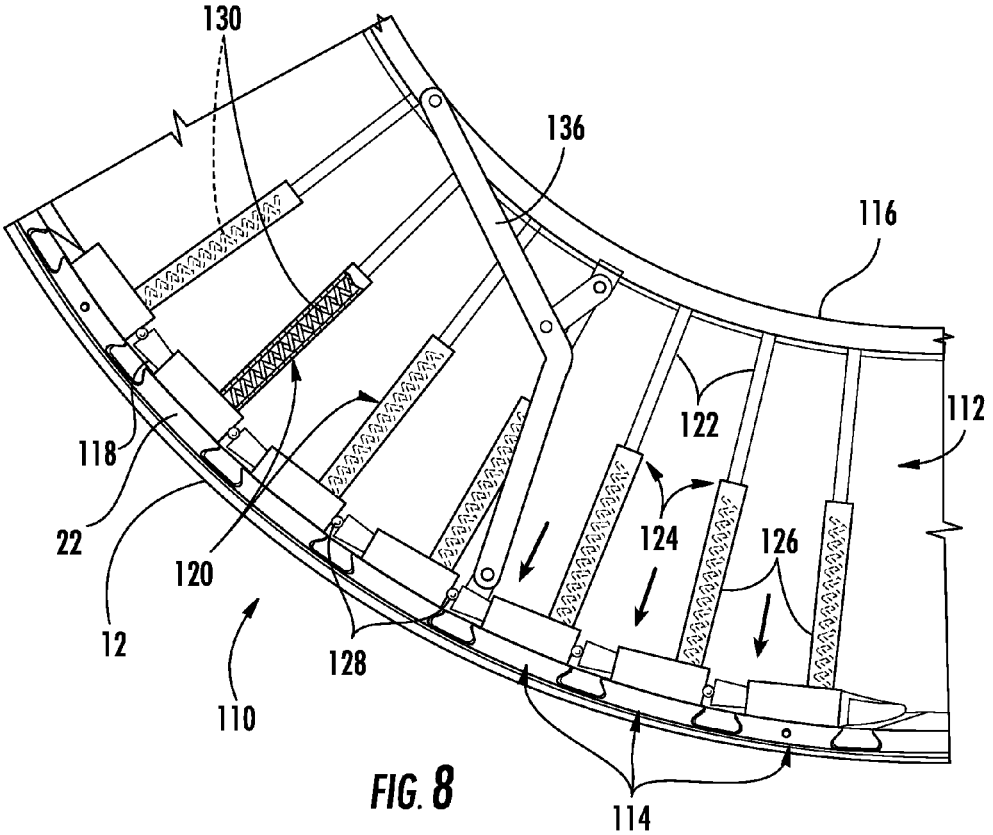
FIG. 8 is a perspective view of the system shown in FIG. 5 heating a stator segment.

FIG. 6 provides a flow diagram of a method for heating stator segments 22 according to one embodiment of the present invention, and FIGS. 7 and 8 illustrate various positions of the system 110 shown in FIG. 5 when positioning and operating the system 110. At block 140, the method may include moving the heaters 114 toward the first frame member 116 so that the heaters 114 and the first frame member 116 may fit between the casing 12 and the rotor 18. As shown in FIG. 7, for example, the heaters 114 may be moved toward the first frame member 116 by manipulating the lever 136 pivotally connected to the first and second frame members 116, 118. As the lever 136 is moved toward the first frame member 116, the lever 136 compresses the spring 130 connected between the first and second members 116, 118. As the spring 130 is compressed, the upper arm segment 122 may slide inside the lower arm segment 126, moving the heaters 114 closer to the first frame member 116.

Returning to FIG. 6, at block 142, the heaters 114 and the first frame member 116 may then be inserted between the casing 12 and the rotor 18, with the heaters 114 passing over the stator segment 22 to be heated. At block 144, the heaters 114 may be extended from the first frame member 116 and towards the stator segment 22 to be heated, as shown in FIG. 8. The heaters 114 may be extended from the first frame member 116 by releasing the lever 136 and allowing the spring 130 to force the upper arm segment 122 out of the lower arm segment 126, thus extending the heaters 114 apart from the first frame member 116 and toward the stator segment 22. If desired, the heaters 114 may be pivoted and/or pressed against the stator segment 22 to apply additional pressure by the heaters 114 against the stator segment 22, represented by block 146 in FIG. 6. The optional pivoting and/or pressing of the heaters 114 against the stator segment 22 may be accomplished, for example, by manipulating the lever 136 further away from the first frame member 116 to increase the force of the heaters 114 against the stator segment 22.

At block 148, the heaters 114 are energized to simultaneously heat the entire stator segment 22. Depending on the particular application and ambient temperatures, the heaters 114 may heat the entire stator segment 22 to greater than 1,000 degrees Fahrenheit in approximately 5-10 minutes, providing a substantial time savings over current systems and methods. At block 150, the heaters 114 may be de-energized and again moved toward the first frame member 116 so that the heaters 114 are retracted away from the stator segment 22. At block 152, the heaters 114 and the first frame member 116 may be withdrawn or removed from between the casing 12 and the rotor 18, and the quenching process may be separately conducted to remove the stator segment 22 from the casing 12.

One of ordinary skill in the art will readily appreciate that the systems and methods disclosed herein will substantially reduce the time to heat stator segments 22 while also reducing the risk of collateral damage to adjacent components. Specifically, it is anticipated that the systems and methods disclosed herein will reduce the time required to heat and quench stator segments by 12-24 hours per compressor, which provides a substantial reduction in the required outage to remove and/or replace stator segments 22. In addition, the particular heaters 114 that may be incorporated into various embodiments may avoid the hazards associated with open flames present in existing systems, thereby reducing the risk of damaging or igniting adjacent components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for heating a stator segment, comprising:

a first frame member;

a second frame member separated from the first frame member;

a plurality of arms extending radially from the first frame member;

a heater releasably connected to each arm; and means for biasing each heater away from the first frame member, the means for biasing being connected between the first frame member and the second frame member.

2. The system as in claim 1, wherein the first frame member has an arcuate shape that conforms to an outer surface of a rotor.

3. The system as in claim 1, wherein each heater comprises an induction heater.

4. The system as in claim 1, wherein each heater comprises a ceramic outer surface.

5. The system as in claim 1, wherein the means for biasing each heater away from the first frame member comprises a spring connected to one or more of the plurality of arms.

6. The system as in claim 1, further comprising means for biasing each heater toward the first frame member.

7. The system as in claim 6, wherein the means for biasing each heater toward the first frame member comprises a lever pivotally connected to at least one of the first frame member or one or more of the plurality of arms.

8. The system as in claim 1, further comprising a pivotal coupling between each arm and each heater.

9. The system as in claim 1, further comprising a second frame member connected to each heater.

10. A system for heating a stator segment, comprising:

a first frame member;

a second frame member separated from the first frame member;

a plurality of heaters connected to the second frame member; and means for biasing each heater away from the first frame member, the means for biasing being connected between the first frame member and the second frame member.

11. The system as in claim 10, wherein the second frame member has an arcuate shape that conforms to the stator segment.

12. The system as in claim 10, wherein each heater comprises an induction heater.

13. The system as in claim 10, wherein the means for biasing each heater away from the first frame member comprises a spring connected between the first frame member and the second frame member.

14. The system as in claim 10, further comprising means for biasing each heater toward the first frame member.

15. The system as in claim 14, wherein the means for biasing each heater toward the first frame member comprises a lever pivotally connected to at least one of the first frame member or the second frame member.

16. The system as in claim 10, further comprising a pivotal coupling between the second frame member and each heater.

17. A system for heating a stator segment, comprising:

a first frame member;

a second frame member separated from the first member;

a plurality of arms extending radially from the first frame member towards the second frame member;

a heater releasably connected to each arm; and a biasing element operably connected to the first frame member and each heater to bias each heater away from the first frame member, the biasing element being connected between the first frame member and the second frame member.

18. The system as in claim 17, wherein the first frame member has an arcuate shape that conforms to an outer surface of a rotor.

19. The system as in claim 17, wherein the biasing member comprises a spring connected to one or more of the plurality of arms.

20. The system as in claim 17, further comprising a pivotal coupling between each arm and each heater.

* * * * *